US011414863B2

(12) United States Patent
Royce

(10) Patent No.: US 11,414,863 B2
(45) Date of Patent: Aug. 16, 2022

(54) REFINED PRESTRESSED CONCRETE ELEMENTS

(71) Applicant: Advanced Bridge Construction Technologies, Inc., Fredericksburg, VA (US)

(72) Inventor: Mathew Chirappuram Royce, Fredericksburg, VA (US)

(73) Assignee: ADVANCED BRIDGE CONSTRUCTION TECHNOLOGIES, INC, Fredericksburg, VA (US)

( * ) Notice: Subject to any disclaimer, the term of this patent is extended or adjusted under 35 U.S.C. 154(b) by 0 days.

(21) Appl. No.: 17/142,801

(22) Filed: Jan. 6, 2021

(65) Prior Publication Data

US 2021/0229319 A1 Jul. 29, 2021

Related U.S. Application Data

(60) Provisional application No. 62/958,893, filed on Jan. 9, 2020.

(51) Int. Cl.
*E04B 5/06* (2006.01)
*B28B 23/22* (2006.01)
(Continued)

(52) U.S. Cl.
CPC ..... *E04B 5/06* (2013.01); *B28B 23/046* (2013.01); *B28B 23/22* (2013.01); *E04C 3/26* (2013.01); *E04C 5/073* (2013.01)

(58) Field of Classification Search
CPC ..... B28B 23/22; B28B 23/046; E04B 5/06; E04C 5/073; E04C 3/26; E01D 2/02; E01D 2101/26; E01D 2101/28
See application file for complete search history.

(56) References Cited

U.S. PATENT DOCUMENTS 2,859,504 A * 11/1958 Crowley ..... E04C 3/26 264/228
3,577,504 A * 5/1971 Lipski ..... E04C 3/20 264/255

(Continued)

FOREIGN PATENT DOCUMENTS

CA 2932655 A1 * 6/2015 ..... E04B 5/06
CN 208917657 U * 5/2019

*Primary Examiner* — Jessie T Fonseca
(74) *Attorney, Agent, or Firm* — Patent Portfolio Builders PLLC

(57) ABSTRACT

Disclosed invention comprises innovations in the fabrication process and the associated design methodology for producing refined prestressed concrete elements/components. The innovations disclosed are fabrication using multiple stages, the use of ultra high strength materials for only critical subcomponents, utilizing thinner sections made of ultra high strength materials, and a unique method of inducing and controlling camber. The embodiments of this invention enable the accelerated construction of concrete structures that are both durable and cost effective. This disclosure demonstrates the significant improvements to the prior art in the areas of durability, constructability, and cost reduction for prestressed concrete components. The embodiments presented in this disclosure are for bridge superstructure applications.

6 Claims, 13 Drawing Sheets

(51) Int. Cl.

| | |
|---|---|
| ***E04C 5/07*** | (2006.01) |
| ***B28B 23/04*** | (2006.01) |
| ***E04C 3/26*** | (2006.01) |

(56) References Cited

U.S. PATENT DOCUMENTS

| | | | | | |
|---|---|---|---|---|---|
| 5,104,089 | A * | 4/1992 | Shook | E01D 21/00 | 249/211 |
| 5,483,716 | A * | 1/1996 | Burnaman | E01D 19/125 | 14/73 |
| 5,655,349 | A * | 8/1997 | Ghali | E04B 5/43 | 52/334 |
| 6,145,270 | A * | 11/2000 | Hillman | E01D 2/00 | 14/6 |
| 6,345,403 | B1 * | 2/2002 | Nagle | E01D 2/02 | 14/77.1 |
| 2006/0251851 | A1 * | 11/2006 | Bowman | B32B 3/06 | 428/71 |
| 2011/0099941 | A1 * | 5/2011 | Yegge | E04C 3/26 | 52/831 |
| 2013/0269125 | A1 * | 10/2013 | Grace | E01D 19/125 | 14/73 |

* cited by examiner

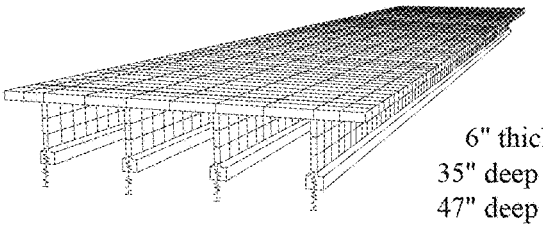
FIG. 19A
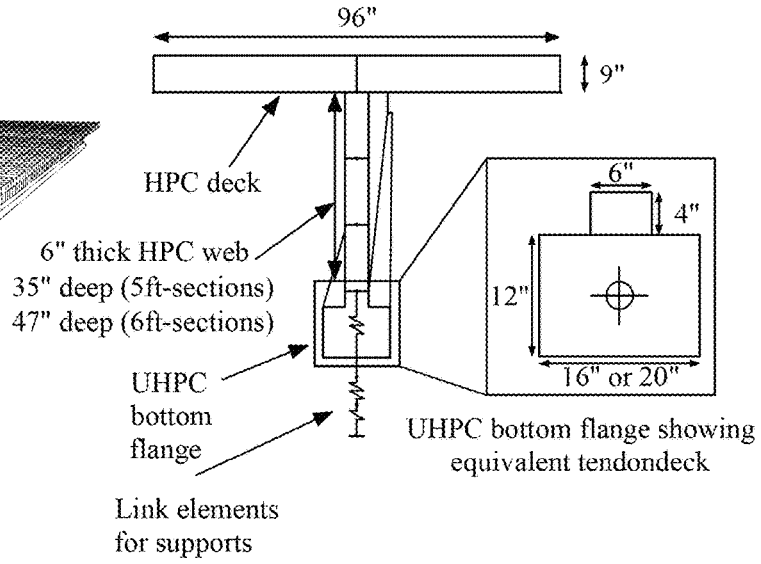
FIG. 19B
| Section | Number of Tendons | Tendon Force | Total Force in Equivalent Tendon | Width of Bottom Flange | Gross Area of UHPC | Section Modulus – Tension Fiber | Section Modulus – Compression Fiber |
|---|---|---|---|---|---|---|---|
| | | Kip | Kip | in | $in^2$ | $in^3$ | $in^3$ |
| 5ft | 39 | 44 | 1716 | 20 | 264 | 465 | 640 |
| 6ft | 29 | 44 | 1276 | 16 | 216 | 406 | 537 |
Fig. 20

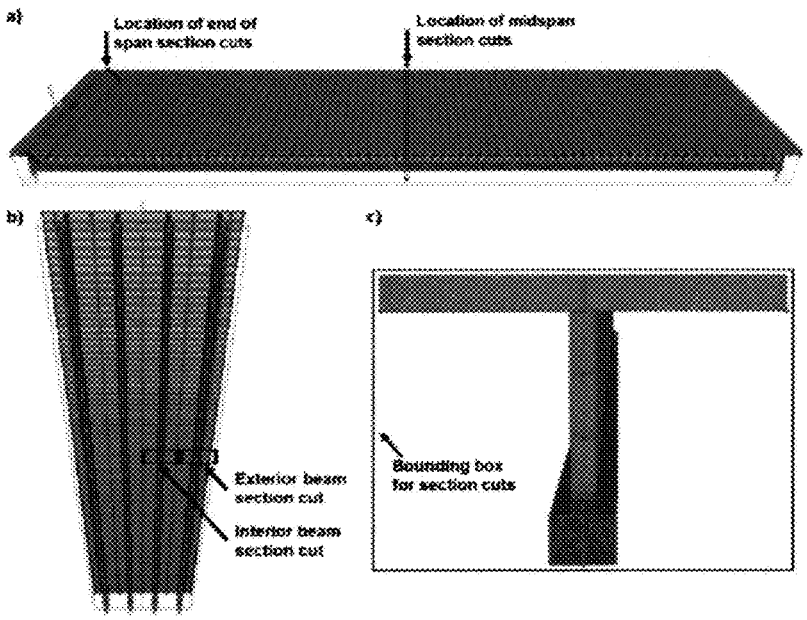

Fig. 21

| Section | Section | Maximum Compressive Stress Ksi | Maximum Compressive Stress Ksi |
|---|---|---|---|
| 5ft | UHPC Bottom Flange | UHPC after losses, prior to HPC cast | -7.5 |
| | HPC Top Flange | Service I permanent loads | -1.1 |
| | HPC Top Flange | Service I permanent and transient loads | -2.2 |
| 6ft | UHPC Bottom Flange | UHPC after losses, prior to HPC cast | -7.1 |
| | HPC Top Flange | Service I permanent loads | -0.9 |
| | HPC Top Flange | Service I permanent and transient loads | -1.9 |

Fig. 22

| Section | Section Cut | Load Combination | Net Stress in UHPC at Extreme Fiber Ksi | Demand-to-Capacity Ratio |
|---|---|---|---|---|
| 5ft | Exterior Bottom Flange at Midspan | Service III | -0.11 | * |
| | Interior Bottom Flange at Midspan | | -0.43 | * |
| 6ft | Exterior Bottom Flange at Midspan | Service III | 0.14 | 0.16 |
| | Interior Bottom Flange at Midspan | | -0.20 | * |

*Section does not experience tension.

Fig. 23

| Section | Section Cut | Load Combination | Peak Moment Capacity Kip-in | Post-Peak Moment Capacity Kip-in | Maximum Moment Demand at Midspan Kip-in | Demand-to-Capacity Ratio |
|---|---|---|---|---|---|---|
| 5ft | Exterior Beam at Midspan | Strength I | 122500 | 114800 | 104200 | 0.85 |
| | Interior Beam at Midspan | | | | 95500 | 0.78 |
| 6ft | Exterior Beam at Midspan | Strength I | 114000 | 104600 | 107700 | 0.95 |
| | Interior Beam at Midspan | | | | 98100 | 0.86 |

Fig. 24

| Section | Load Combination | Maximum Shear Stress from Hand Calculations | Maximum Shear Stress from Model |
|---|---|---|---|
| | | Ksi | Ksi |
| 5ft | LL | 0.59 | 0.52 |
| | Strength I | 0.99 | 0.89 |
| 6ft | LL | 0.44 | 0.40 |
| | Strength I | 0.77 | 0.76 |

Fig. 25

REFINED PRESTRESSED CONCRETE ELEMENTS

BACKGROUND OF THE INVENTION

Field of the Invention

The present invention is related to prestressed concrete elements (hereinafter also referred to as prestressed concrete components), specifically regarding innovations in the fabrication process of these components and the associated design methodology.

Description of Prior Art

Over the last 50 years, there have been only limited advances in the state of the art for the design and fabrication of prestressed concrete bridge components. For example, the Deck Bulb Tee (DBT) beam has been an option for prestressed concrete prefabricated segmental superstructure construction since the 1980s, but has undergone minimal changes in either material composition or fabrication processes. Though the fabrication and design of concrete components has remained relatively unchanged, advances in cementitious materials in the past few decades have provided opportunities for greater optimization of both beam design and fabrication procedures. One of the most impactful advances in cementitious materials has been the development and expanded use of Ultra-High Performance Concrete (UHPC). UHPC has many advantages compared to conventional or High Performance Concrete (HPC) including increased tensile strength, compressive strength, permeability resistance, and durability. The aforementioned advantages of UHPC are particularly attractive for prestressed beams. For example, the high compressive strength of UHPC enables the use of smaller bottom flanges. In addition, UHPC has higher durability than conventional concrete in terms of freeze-thaw degradation resistance, scaling deterioration, chloride penetration, and abrasion resistance. UHPC also has a low permeability and water absorption capacity which makes the material particularly attractive for use in harsh environments. The high tensile strength and ductility of UHPC reduces the likelihood of cracking the bottom flange and thus preventing corrosion of the strands.

Due to the many benefits of utilizing UHPC, multiple institutions including the Federal Highway Administration (FHWA) and Prestress Concrete Institute (PCI), are currently investigating the application of concrete bridge girders made entirely of UHPC. However, it is anticipated that the increase in cost associated with this change may limit the adoption of these beams in the near future. In addition, full UHPC girders constructed. state of the art fabrication steps do not address other issues with prestressed beams, such as unpredictable camber and potential cracking of the top flange. Taking remedial measures to address differential camber during construction adds both time and complexity to a project, which is especially undesirable for accelerated construction projects.

The state of the art in the design and fabrication of prestressed concrete components is the complete fabrication of a concrete component prior to the introduction of the prestressing force to the sufficiently hardened concrete component. In prior art, only one type of concrete is used for the entire component.

There are four significant issues with prior art materials and fabrication processes, all of which are addressed by the innovations in this invention.

The following are the main inadequacies of prior art:

First, prior art does not have a cost effective approach to achieving sufficient durability. HPC has significantly higher permeability and propensity to cracking compared to materials such as UHPC. The durability of existing prestressed concrete structures when exposed to corrosive environments are well below desired levels. The main reason for this poor performance is the penetration of moisture and corrosive chemicals through the concrete around the prestressing strands. By contrast, UHPC has been performing very well in structural application due to its extremely low permeability and high resistance to cracking; however, UHPC has been limited in its usage due to its significantly higher cost compared to HPC.

Second, with current production methods for prestressed concrete components, parts of the component will experience undesirable tension or bursting forces as an unintentional secondary effect. This tension generally causes cracking of the concrete and reduces the service life of these components requiring frequent repairs or replacements. In the state of the art method of designing and fabricating prestressed concrete components, compressive stresses are introduced into targeted parts which will experience tension from the expected future loads after the full component has been completely fabricated. This precompression will counteract future tensile stresses due to future load effects and will fully eliminate net tensile stress in the targeted parts or limit the tensile stress to a desired level. The state of the art is incapable of avoiding undesirable secondary effects such as tension and/or bursting stresses in some other parts of the component.

Third, design using the state of the art method is constrained due to the limitation of the maximum tension allowable for the top fiber of the top flange near both ends. In the fabrication of prestressed concrete components, for example DBT, the bottom flange benefits from the compression in concrete from the prestressing of the bottom flange. Since the point of application of the total prestressing force is eccentric to the center of gravity of the DBT cross section, tension will be developed at the top fiber of the top flange near both ends. This tension is a limiting factor on maximum prestress applicable to the component and can negatively affect the efficiency of its design.

Fourth, commonly occurring variations in camber require significant corrective measures when prestressed concrete components are assembled to construct a structure. During construction, these corrective measures can add cost and time to projects. When prestressing force is applied to concrete components, such as beams, using the state of the art method, upward deflection (generally referred as camber of beam) occurs. This camber can vary significantly from piece to piece even when the design and fabrication methods are identical, leading to the need for corrective measures when these pieces are assembled to construct a structure.

SUMMARY OF THE INVENTION

This invention comprises innovations in the fabrication process of prestressed concrete components as well as associated changes in the design methodology that will significantly reduce, if not fully eliminate, the aforementioned inadequacies of the prior art. The following are brief descriptions of these innovations. Included in the description of exemplary embodiments of the invention are a description of the benefits afforded by these innovations regarding cost reduction, improved durability, and the acceleration of on-site construction.

Innovation 1 is the staged fabrication for prestressed components in which subcomponents are fabricated in a sequential order culminating in the complete component. Essentially, this is the independent fabrication of the subcomponents of a concrete component, including the application of prestressing force, before the subcomponents are incorporated into the complete component. For example, the bottom flange, top flange, and the web of a concrete beam are subcomponents where the entire beam is defined as a concrete component. This invention includes innovations in the method of designing and fabricating the subcomponents as well as their incorporation into the overall concrete component.

Innovation 2 is the use of ultra high strength and extremely durable cementitious materials, such as UHPC, for only the most critical subcomponent(s) of a prestressed concrete component. This innovative prestressed component is hereinafter referred as a hybrid prestressed concrete component.

Innovation 3 is a method for the design and fabrication of concrete components utilizing thinner sections with ribs or stiffeners for subcomponents made from ultra high strength materials such as UHPC. This innovation will result in a significant reduction in the quantity of material needed per component which in turn reduces the shipping weight and the overall cost of the final product.

Innovation 4 is the method of inducing camber to the prestressed prefabricated components by changing the geometry of one of the subcomponents. This is accomplished through the external application of forces instead of utilizing the eccentricity of prestressing forces to the centroid of a concrete component. The modifications to the geometry of an individual subcomponent is introduced prior to adding or attaching other subcomponents to it. This method is capable of achieving desired camber with tight tolerances.

Innovation 5 includes various methods of connecting prefabricated concrete components in the field to enable easier and faster construction. These details include uniquely shaped UHPC connections and epoxy-applied bolted connections.

DESCRIPTION OF DRAWINGS

In FIG. 1, Item 1 is the Bottom Flange of the HDBT made using UHPC (or other similar materials) and prestressed before Item 2 (the Web) and Item 3 (the Deck) of HPC is added to it in the second stage of fabrication. Item 4 is the Connection between the HDBTs to be established after installation of the units in its final location in the bridge or any other structure. Item 101 is a Concrete Barrier commonly used on bridges.

Figure 1:
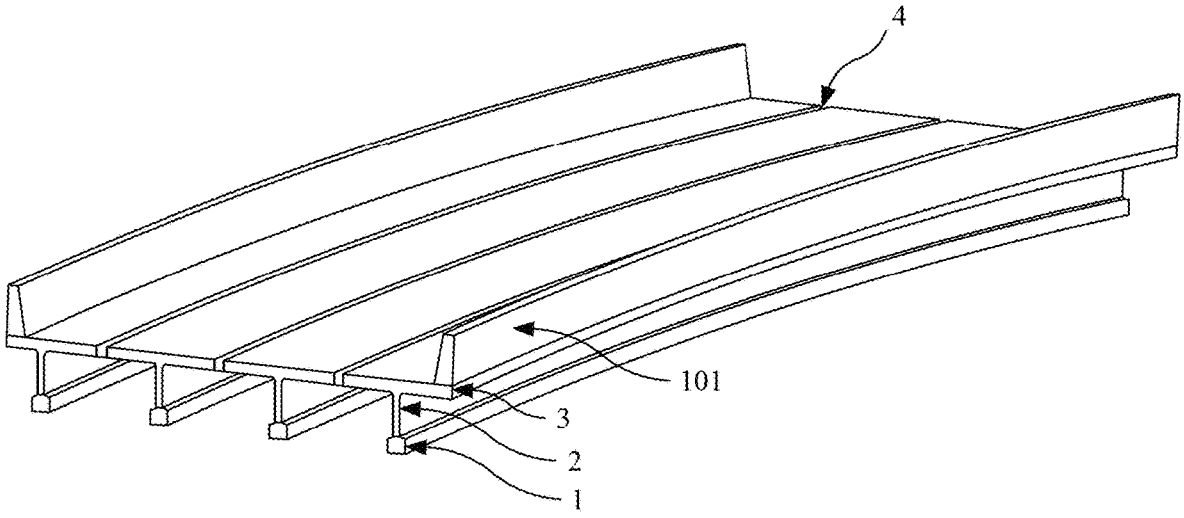
FIG. 1 is a representation of a three-dimensional digital model of a bridge superstructure constructed utilizing the preferred first embodiment of the present invention which is Hybrid Deck Bulb Tees (HDBT). This embodiment of the invention utilizes innovations 1, 2, 4 and 5 of this patent.
Figure 2:
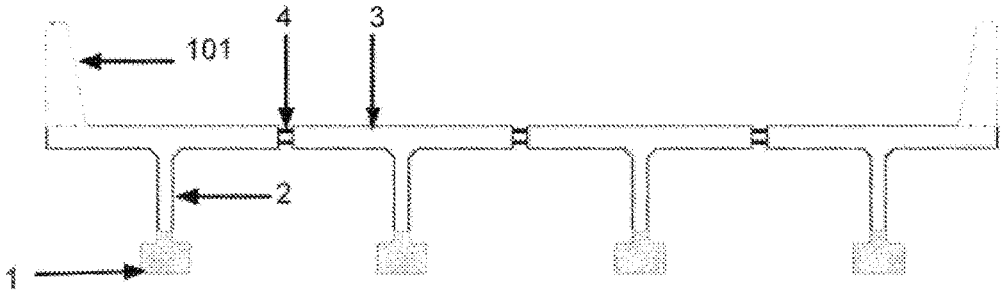
FIG. 2 is a transverse sectional view of the bridge superstructure shown in FIG. 1.

Refer to FIG. 1 descriptions for identification of Items 1, 2, 3 and 4 in FIG. 2.

Figure 3:
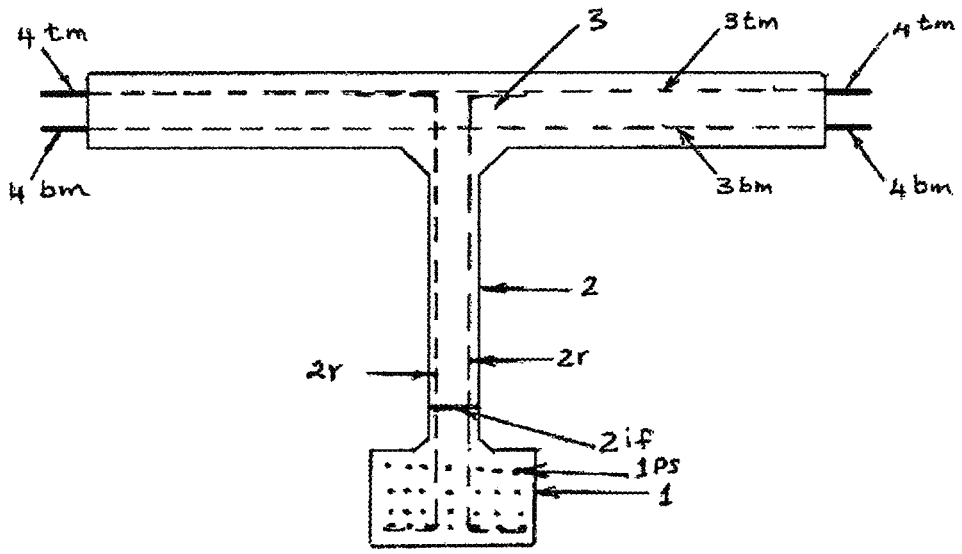

FIG. 3 is a more detailed transverse sectional view of an individual HDBT. For identifications of Items 1, 2, 3 and 4 refer to FIG. 1.

Item 1*ps* is the Prestressing strands for applying precompression to Item 1.

Item 2*if* is the interface between UHPC and HPC within Item 2.

Item 2*r* is the reinforcement within Item 2.

Item 3*bm* is the bottom mat of reinforcement within Item 3.

Item 3*tm* is the top mat of reinforcement within Item 3.

Item 4*bm* is the projection of the 3*bm* into Item 4.

Item 4*tm* is the projection of the 3*tm* into Item 4.

Figure 4:
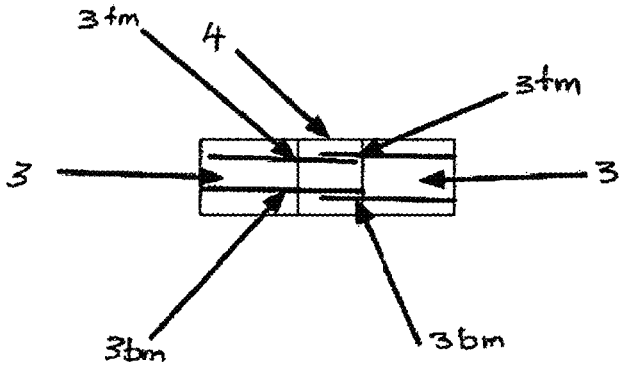

FIG. 4 is a transverse section taken through one geometric shape of Item 4. This connection utilizes field-cast UHPC connections currently is the state of the art for field cast UHPC connections.

For identifications of Items 1, 2, 3 and 4 refer to FIG. 1.

For identifications of Items 3*tm*, 3*bm*, 4*tm* and 4*bm* refer to FIG. 3.

Figure 5:
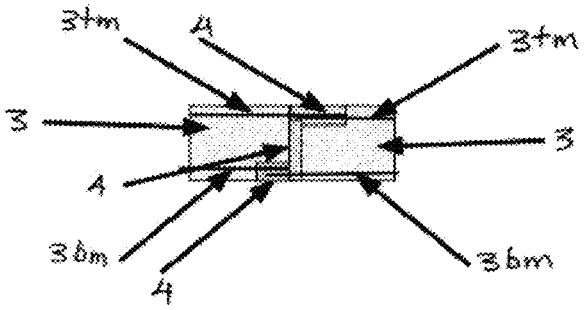

FIG. 5 is a transverse section taken through another geometric shape of Item 4.

This connection also utilizes field-cast UHPC, as well as an innovative shape that is part of this invention. This shape allows for faster installation and reduction of the amount of UHPC required per unit length of these connections.

For identifications of Items 1, 2, 3 and 4 refer to FIG. 1.

For identifications of Items 3*tm*, 3*bm*, 4*tm* and 4*bm* refer to FIG. 3.

Figure 6:
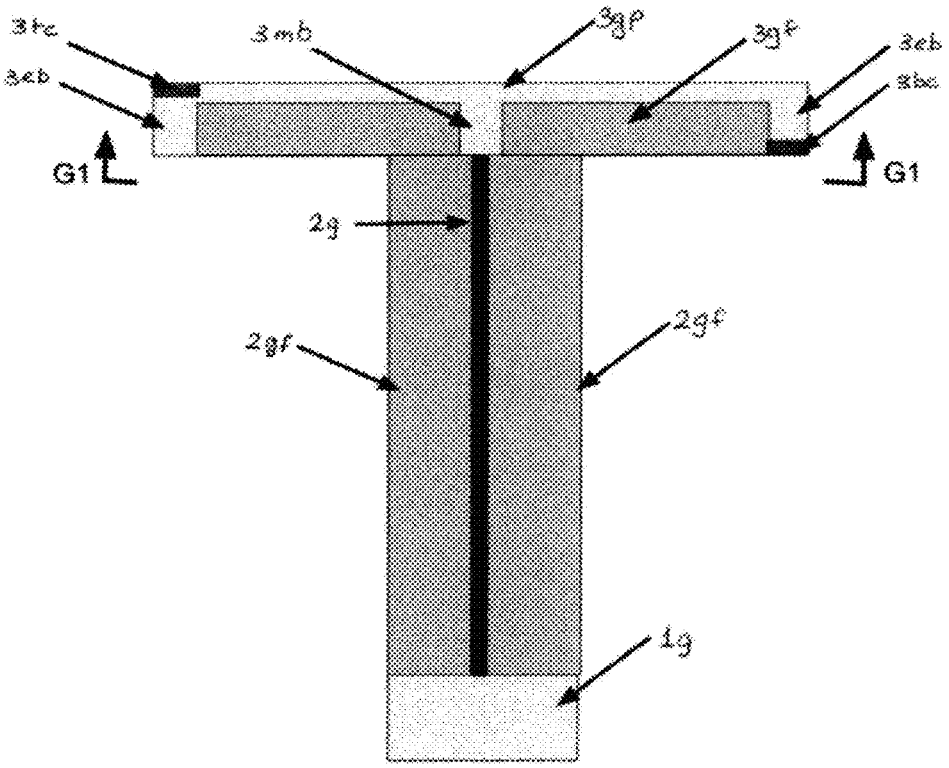

FIG. 6 is a detailed transverse sectional view of the second preferred embodiment of the present invention. This embodiment of the invention utilizes innovations 1, 3, 4 and 5 of this invention. This embodiment of the invention is hereinafter referred to as Grid Deck Bulb Tees (GDBT).

Thinner sections are used for the web and top flange of this embodiment. The innovation of utilizing ribs or stiffeners to increase the structural capacity of thin concrete components made of ultra high strength materials such as UHPC is demonstrated in this embodiment, which is not used in the first preferred embodiment HDBT. All subcomponents of GDBT are made using UHPC (or other similar materials.)

Item 1*g* is the Bottom Flange of the GDBT independently fabricated and prestressed before the Web and the Deck are added in the second stage of fabrication.

Item 2*g* is the thin web plate stiffened using Item 2*gf* web stiffeners.

Item 3*gp* is the thin deck plate stiffened transversely using Item 3*gf* (Plate Stiffeners), stiffened longitudinally along the edges of Item 3*gp* by Item 3*eb* (the Edge Beam) and longitudinally along the middle using 3*bm* (the Middle Beam).

3*tc* is the Blackout for top connection and 3*bc* is the Blackout for bottom connection for use with connection shown in FIG. 5. See FIG. 7 for view G1-G1.

Figure 7:
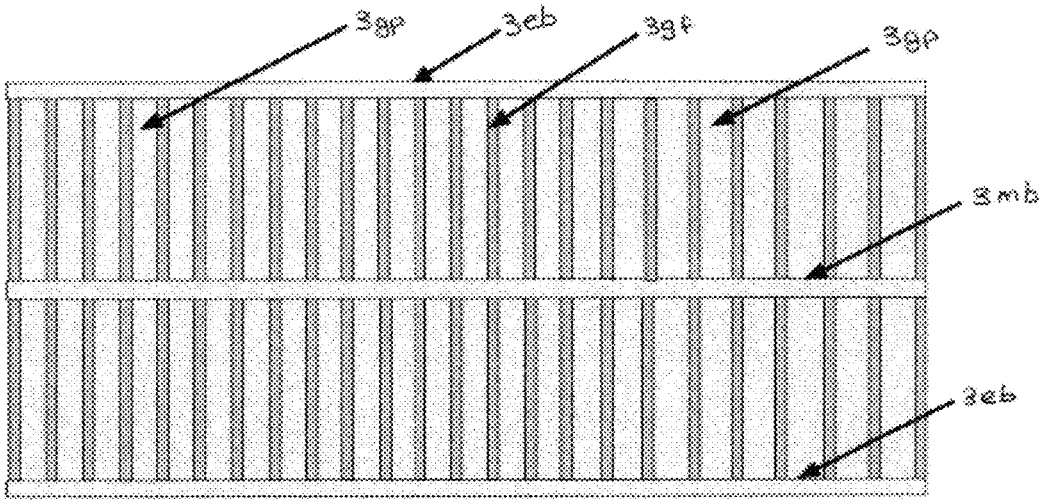

FIG. 7 is a bottom up view of the deck portion GDBT, shown as section G1-G1 in FIG. 6. For identifications of Items 3*gp*, 3*gf*, 3*eb* and 3*bm* refer to FIG. 6.

Figure 8:
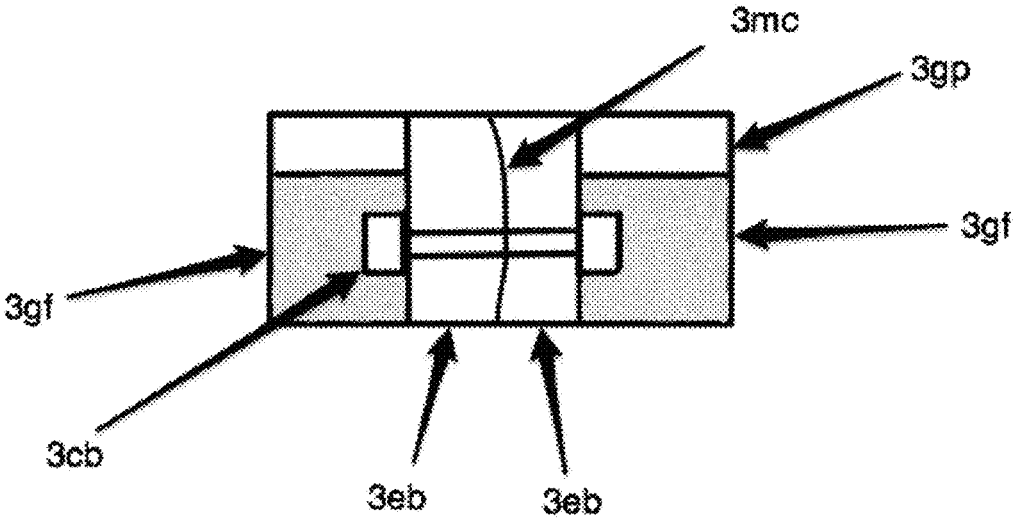

FIG. 8 is a transverse section taken through another type of connection between GDBTs. For identifications of Items 3*gp*, 3*gf*, 3*eb* refer to FIG. 6.

Item 3*cb* is a Bolting System for applying compression into the Item 3*cb* epoxy-applied Mating Surface between the Item 3*eb*.

Figure 9:
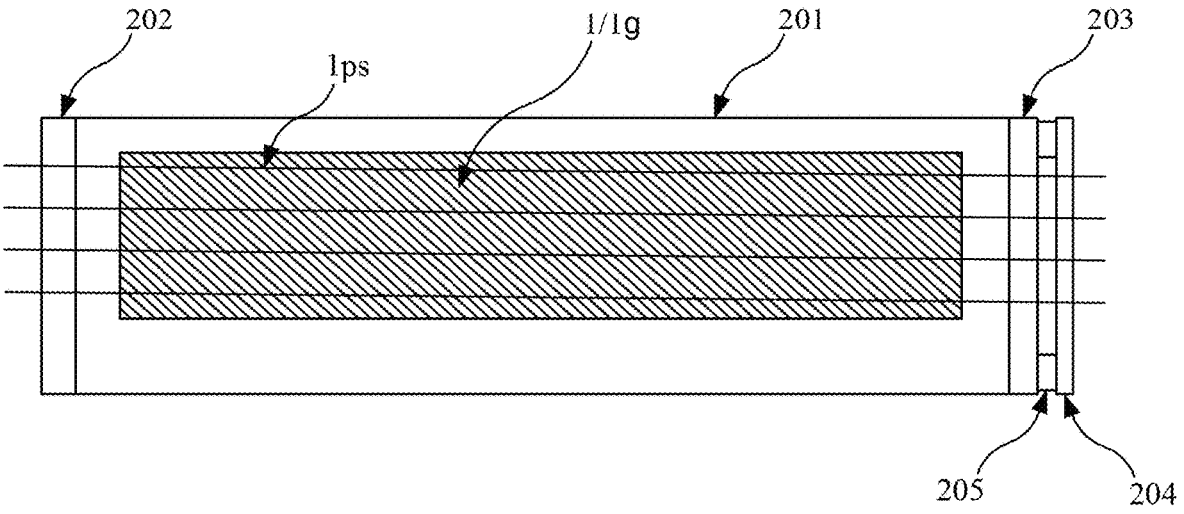

FIG. 9 is a view of the longitudinal section taken along the middle of a self-stressing bed for fabricating Item 1 or Item 1*g* using the pretensioning method of prestressing. Refer to FIG. 1 for the identification of Item 1 and FIG. 3 for the identification of Item 1*ps*. Refer to FIG. 7 for the identification of Item 1*g*.

Item 201 is the sides and bottom of the prestressing bed made using UHPC.

Item 202 is the Anchoring steel plate at the dead end of the prestressing system.

Item 201 is the Anchoring Steel Plate at the dead end of the prestressing system.

Item 201 Stressing steel plate for gang stressing of strands at the live end of the prestressing system.

Item 205 is the Stressing Jacks for gang stressing of strands at the live end of the prestressing system.

Figure 10:
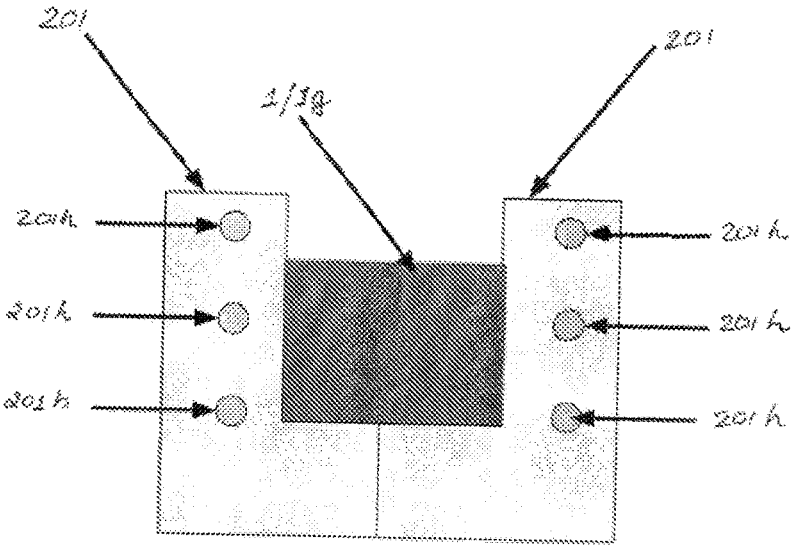

FIG. 10 is a view of the transverse section taken along the middle of a self-stressing bed constructed using UHPC for the fabrication of Item 1 or Item 1*g*. Refer to FIG. 7 for the identification of Item 1*g*. Refer to FIG. 9 for the identification of Item 201. Item 201*h* is the heating ducts installed within Item 201.

Figure 11:
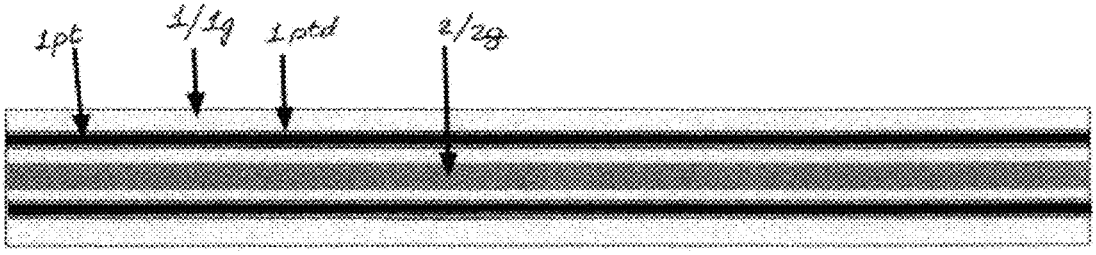

FIG. 11 is the plan view of Item 1 or Item 1*g* fabricated utilizing the post-tensioning method of prestressing. Refer to FIG. 1 for the identification of Item 1 and Item 2 Refer to FIG. 7 for the identification of Item 1*g* and Item 2*g*.

Item 1*pt* is the Tendons for post-tensioning and Item 1*ptd* is the Grouted Duct for post tensioning.

Figure 12:
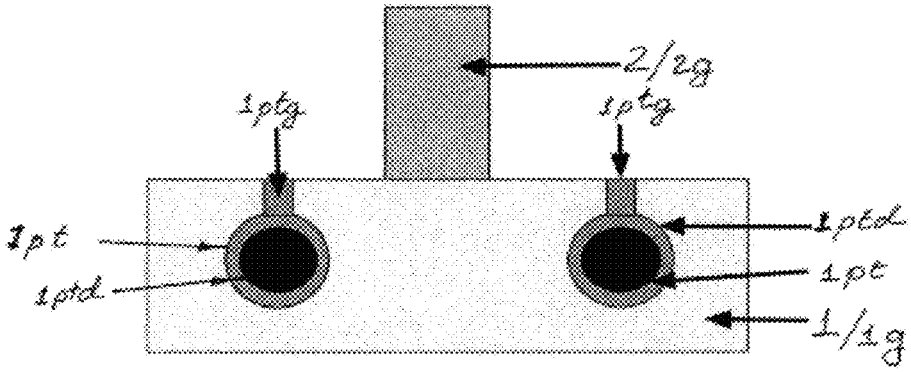

FIG. 12 is the transverse section of Item 1 or Item 1*g* fabricated utilizing the post-tensioning method of prestressing. Refer to FIG. 1 for the identification of Item 1 and Item 2. Refer to FIG. 7 for the identification of Item 1*g* and Item 2*g*. Item 1*ptg* is the Grouting Ports for Item 1*ptd*.

Figure 13:
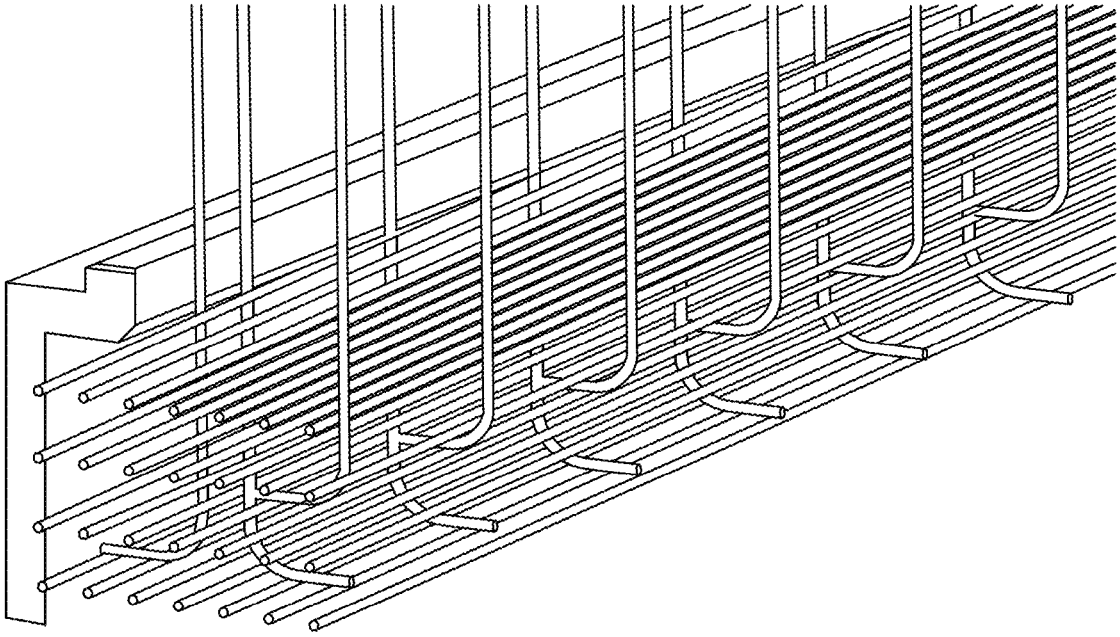

FIG. 13 shows the bottom flange in the first stage of the staged fabrication process, highlighting interior elements. The figure illustrates the placement of steel reinforcement and tendons within this bottom flange.

Figure 14:
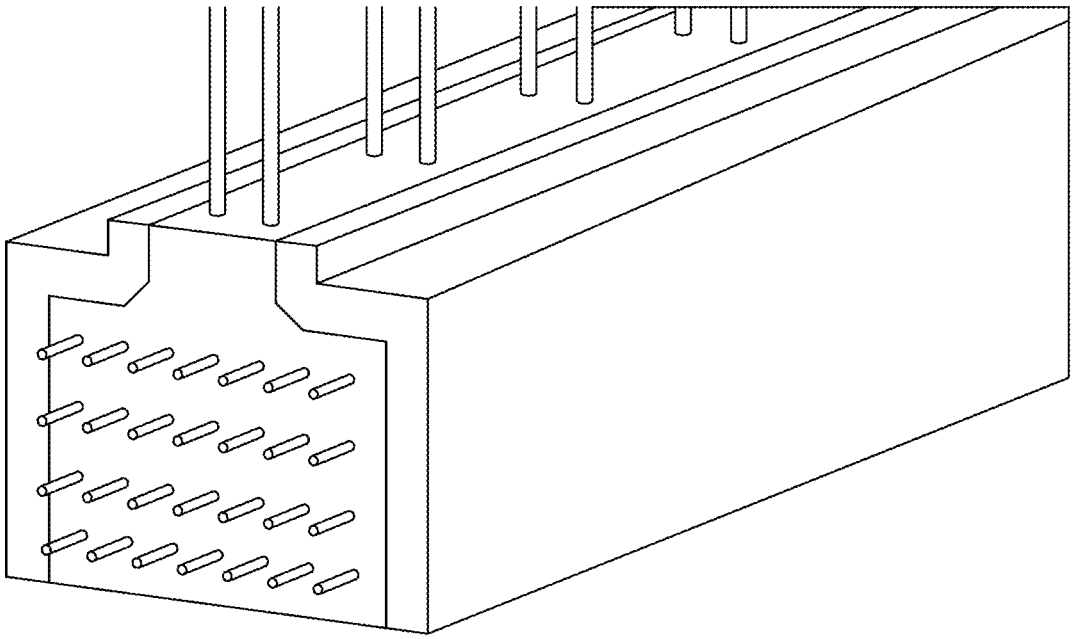

FIG. 14 shows the bottom flange in a later stage of the staged fabrication process, with added tension and the UHPC being cast and allowed to cure inside the bottom flange.

Figure 15:
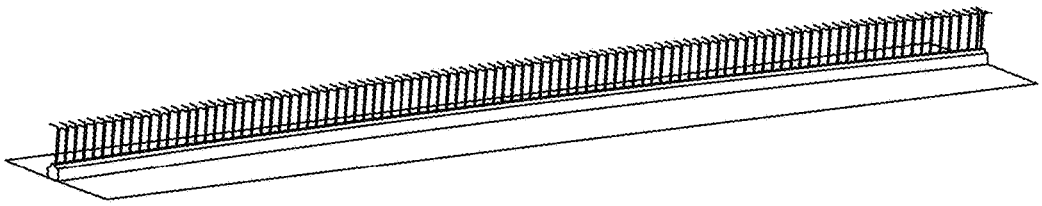

FIG. 15 displays the bottom flange with the full geometry of the tendons extending up through the web and into the deck, into the desired geometric shape in order to develop the desired positive camber for the completed element.

Figure 16:
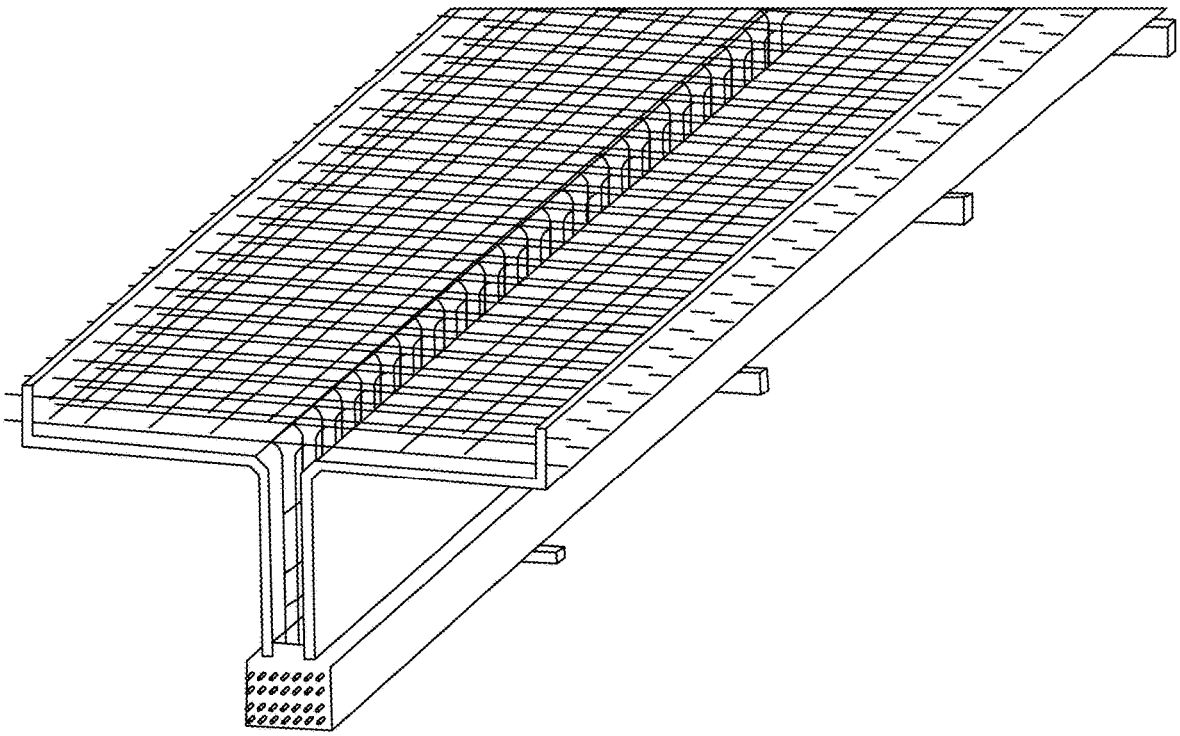

FIG. 16 displays the assembled form placed over the shored bottom flange to produce the desired shape for the structure.

Figure 17:
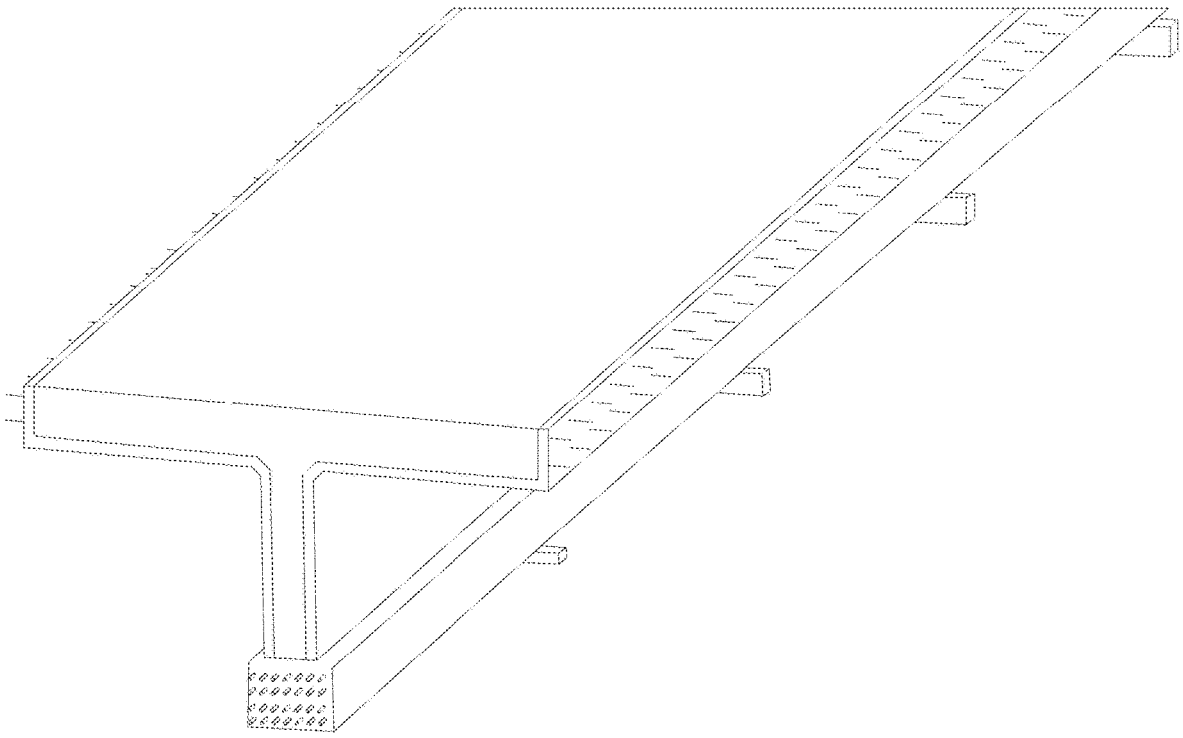

FIG. 17 shows the assembled form filled with HPC. The HPC is cured in the assembled forms until it achieves the desired compressive strength.

Figure 18:
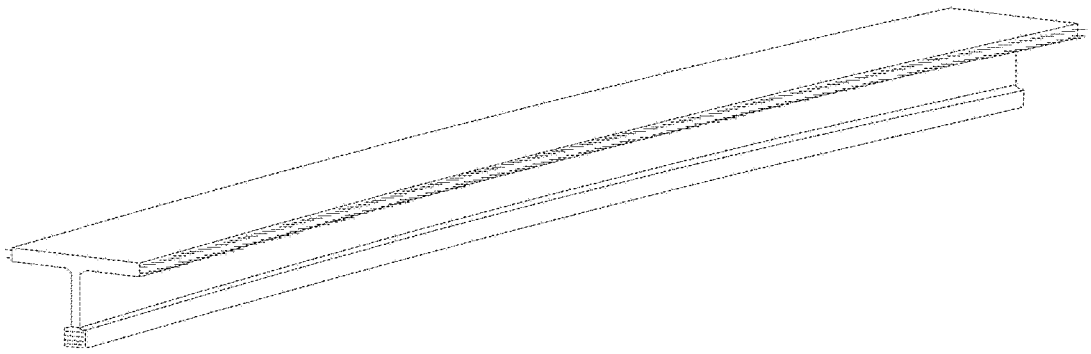

FIG. 18 displays the full deck beam after it's been filled and the deck has reached reasonable strength.

FIG. 19 provides an example overall schematic representation of the finite element model to illustrate the design methodology. This example shows a 125 foot single span highway bridge design using AASHTO LRFD design specifications.

FIG. 20 is a table of exemplar sets of key dimensions and measures to achieve desired performance.

FIG. 21 provides section cuts at mid-span and the end of the span, to evaluate the structural performance of the modeled element.

FIG. 22 is a table of the compressive stresses at different stages of the fabrication as well as the in-service condition, based on the model of the example schematic.

FIG. 23 is a table which uses the model of the example schematic in order to provide the tensile stresses during the in-service condition and respective demand to capacity ratios.

FIG. 24 is a table which uses the model of the example schematic in order to provide the moment demand to capacity ratios.

FIG. 25 is a table providing both the hand calculation and model-based analysis evaluations of the structural performance (maximum shear stress) at the interface of the UHPC and HPC web components.

DETAILED DESCRIPTION OF THE EXEMPLARY EMBODIMENTS

This invention comprises innovations in the fabrication process of prestressed concrete components and associated changes in the design methodology that will significantly reduce, if not fully eliminate, inadequacies of the prior art. Included in this disclosure are descriptions of exemplary embodiments of these innovations and their utility in the areas of cost reduction, improved durability, and acceleration of on-site construction.

All descriptions herein with reference to the figures are not limiting and should be understood as features of varying details of the presented embodiment. The features, components, elements, and/or aspects of the illustrations can be reorganized, resequenced, and/or interchanged with other materials without effectively departing from the disclosed invention. The geometry of the components are also exemplary and can be altered without effectively affecting or limiting the disclosed invention. The drawings and associated descriptions of the preferred embodiments of the invention shall be treated as an example and is intended for making the invention readily apparent to those with ordinary skill in the art. The presentation of the preferred embodiments of the invention shall not be regarded as limiting since the invention is capable of other embodiments and can be practiced or carried out in multiple ways.

Description of the Preferred First Embodiment

FIGS. 1 through 5 depict HDBT, the preferred first embodiment of the present invention. FIG. 1 is an image of a three-dimensional digital model of a single span bridge superstructure constructed utilizing HDBTs. Repeated use of this arrangement can produce a multi-span bridge. This figure shows how these prefabricated prestressed concrete superstructure segments are arranged and connected to form one span a bridge superstructure. The number of units shown as well as the connection between them is exemplary; a varied number of units with a plurality of connection details shall be regarded as included in this invention.

Staged fabrication is used in this embodiment. The bottom flange, top flange, and the web are subcomponents of an HDBT whereas the unit after combining the process of combining them into one is defined as a concrete component, the completed HDBT.

Bottom Flange (Item 1) is a subcomponent of HDBT which is fabricated using UHPC and prestress is applied to it before remaining portions of the HDBT. Web (Item 2) and Flange (Item 3) are added to it as the second stage of the fabrication. FIG. 1 is an example of how HDBTs will be assembled on top of bridge substructures, such as abutments or piers, to form a bridge superstructure. Substructures supporting the ends of HDBTs are implied in this figure and are not shown. The performance benefits of the HDBT are dependent on the staged fabrication sequence. The first stage consists of casting and curing the UHPC bottom flange. In this stage, the form is assembled, and the steel reinforcement and tendons are placed as exemplified in FIG. 13. Tension is applied to the strands and the UHPC is cast and allowed to cure as demonstrated in FIG. 14. The top surface of the UHPC is made rough to provide a better interface at the joint between the UHPC and HPC in the web. When UHPC reaches the desired compressive strength, prestress is applied to the bottom flange. Due to the self-weight of the member and layout of the tendons, the prestressing does not result in prestress-induced moment and associated cambering of the bottom flange. Since the bottom flange is receiving prestress as direct compression and the rest of the HDBT is added to it after undesirable secondary effects of tension at the ends of the top flanges and webs are completely eliminated. This will eliminate design limitations on the maximum allowable prestressing force to the bottom flange due to the development of tension in the top flange. An additional benefit of the top flange tension includes control measures such as the debonding of the ends of the prestressing stands and draping up of prestressing strands widely used in the state of the art fabrication of prestressed concrete components will be rendered unnecessary.

Use of UHPC for the bottom flange only is another innovation used in this embodiment of this invention. The primary benefit of this innovation is the drastic improvement in the durability of HDBT over DBTs produced using the state of the art. It has significantly higher durability than HPC in terms of freeze-thaw degradation resistance, scaling deterioration, resistance to chloride penetration, and abrasion resistance. It also has a low permeability and significantly reduced water absorption which makes the material attractive for use in harsh environments. The high tensile strength and ductility of UHPC reduces the likelihood of cracking the bottom flange, which prevents chloride penetration through cracks alleviating a major concern in prestressed concrete components made using HPC.

In addition the high compressive strength of UHPC enables using smaller bottom flanges, as less material is needed to resist the prestressing force. This will result in reduced shipping weight for individual HDBT units and the total dead load of superstructures constructed using them. To develop desired positive camber for the completed HDBT, the bottom flange is shored and set to the desired geometric shape as exemplified in FIG. 15. This innovation in the fabrication process brings tight control of the camber for the completed HDBT.

The inability to control camber of DBTs produced using state of the art fabrication process is a well known issue. The use of HDBTs produced using this innovation eliminates the need for the significant remedial measures employed during the installation of DBTs as well as the required overlays necessary to obtain a smooth riding surface.

The form is assembled over the shored bottom flange to produce the desired geometric shape of the completed HDBT and reinforcement, as needed for the desired structural capacity, is placed within the form as exemplified in FIG. 16.

The form is filled with HPC and cured until the desired level of concrete compressive strength is achieved as exemplified in FIG. 17.

Once the HPC in the form reaches the desired strength, the forms are removed and the completed HDBT is moved to storage as exemplified in FIG. 18.

An innovative design methodology has been developed incorporating the effects of the fabrication process for the preferred first embodiment of this invention. The structural analysis included all phases of the stage fabrication to capture stress accumulation and strain compatibility between stages. The model captures composite action under DC2, DW, and live load. The system is evaluated using multiple criteria including the deflections under Live Load (LL) and Dead Load (DL), design checks for temporary stresses before losses, and stresses at service limit states after losses.

A finite element model is provided to exemplify the design methodology. The model in this example is constructed using a 125 feet single span highway bridge design using the AASHTO LRFD design specifications for highway bridges. The UHPC bottom flange, including the prestressing tendon, is modeled as a beam element with a single tendon element of equivalent area located at the center of gravity of prestressing strands. The web and the deck of HDBT is modeled using shell elements. The support conditions at the ends are pin-rollers. The wearing surface and parapets are defined as area loads and line loads, respectively. The parapets do not contribute to the stiffness of the structure. The reinforcement in the web and the deck was not explicitly modeled. A schematic representation of the overall model used in the example is shown in FIG. 19.

Two different cross sections were evaluated in the example. One section has a total depth of five feet while the other has a depth of six feet. The five-foot-deep section is included as it has a comparable depth to a steel girder superstructure with a similar span length. The six-foot-deep section has a smaller bottom flange and fewer prestressing tendons compared to the five foot section. This section is included to show the versatility of this innovative design methodology. The material properties of UHPC in sample analysis provided below is for illustration of the novel design methodology developed as part of the present invention and shall not be regarded as limiting.

The specified UHPC compressive strength is $f'_d$=14.0 ksi at the release of strands and $f'_c$=22 ksi at 28 days.

The Elastic modulus specified UHPC is 8,000 ksi.

Time-dependent properties of UHPC and HPC are used to capture the effect of the staged fabrication sequence.

HPC compressive strength is 10 ksi and the Elastic modulus is 5,000 ksi.

The creep, shrinkage and stiffness parameters are calculated according to CEB/FIP-90.

The prestressing force is applied using 0.6 inch diameter strands stressed to 44 kips.

The strands are Grade 270.

The strand group is modeled with a single tendon component of equivalent area located at the center of gravity of the tendons.

A multi-step structural analysis process with time-dependent material properties is used to capture effects of the different stages of the fabrication. The first step is the analysis of the UHPC bottom flange with precompression and with UHPC compressive strength of 14 ksi. Additional information is provided FIG. 20.

The second step of analysis is the application of a distributed load necessary to generate the required camber and corresponding stresses.

At HPC strength of 7 ksi, the distributed load is removed, and the complete self-weight of the beam is added to the composite section of the HDBT as the third step of the analysis. This corresponds to when the beam can be lifted from the shoring.

At HPC strength of 10 ksi, the load patterns for the barrier and wearing surface are added to the superstructure model as the fourth step.

The fifth step is when the live load is applied to the structure using a moving load case with floating lanes. The corresponding live load factors for each case are incorporated in the design load combinations.

Section cuts at mid-span and the end of the span as shown in FIG. 21 are generated from the model to evaluate the structural performance of the modeled element.

Compressive stresses at different stages of the fabrication, as well as in the in-service condition of this example, based on the model of the example schematic is provided in FIG. 22.

Tensile stresses during the in-service condition of this example based on the model of the example schematic is provided in FIG. 23.

Capacity to Demand ratios of this example based on the model of the example schematic is provided in FIG. 24.

The staged fabrication of the HDBT component results in an interface between the UHPC and HPC components of the web. Two methods are used to evaluate the structural performance of this interface. Hand calculations and model-based analysis are used to determine the interface shear at this location. Results of these two methods are given FIG. 25.

Improvements Over the Prior Art by the Preferred First Embodiment

The preferred first embodiment of the present invention, HDBT, will significantly reduce, if not fully eliminate, all inadequacies of the prior art described in this disclosure.

No tension will be developed at the top fiber of the top flange and the web near both ends of the HDBT through the staged fabrication method. The prestress is imparted into the bottom flange as an independent unit therefore no other part of the HDBT will experience tension.

The limitation in design efficiency in the state of the art due to the maximum tension on the top flange caused by the negative effects of prestress is completely eliminated.

With the secondary effects of prestress removed, there is a reduced risk of concrete deck deterioration which substantially improves the durability of the superstructure.

Fabrication is made easier and cheaper as the present invention negates the need for the draping of stands as well as the debonding of strands near the ends of a prestressed concrete component to reduce tension in the deck.

The present invention also negates the need for the special treatments of the anchorage zones in prestressed components which eases the fabrication process and reduces cost.

The camber variations from piece to piece of HDBT will be insignificantly low since the camber is measured and controlled by the shoring of the bottom flange before the rest of the HDBT is added to it. HDBTs will not need corrective measures when assembled in the field to construct the final structure.

Even though UHPC is a highly desirable material for producing durable concrete components, its use in the fabrication of concrete components is not common practice due to its significantly higher cost. In HDBT, UHPC usage is strategically limited to the bottom flange encasing the prestressing strands, which is the most vulnerable and critical part of any prestressed concrete component. The durability of HDBT is significantly enhanced by this approach while balancing a minimal cost increase from the UHPC use.

Since the compressive strength of UHPC is significantly higher than HPC, the size of the bottom bulb can be reduced significantly thereby reducing the overall weight of the HDBT compared to DBT made using traditional HPC.

Description of the Preferred Second Embodiment

Another embodiment of this invention, GDBT, could be used as an alternative to HDBT for the bridge superstructure in FIG. 1. FIGS. 6 through 8 depict the preferred second embodiment of the present invention, GDBT.

The fabrication process for GDBTs is similar to that of HDBTs except that form work for webs and the flanges are capable of producing thinner sections with stiffeners. The innovation of utilizing ribs or stiffeners to increase the structural capacity of thin concrete components made of ultra high strength materials, such as UHPC, is demonstrated in this embodiment, which is not used in the first preferred embodiment (HDBT). All subcomponents of GDBT are made using UHPC (or other similar materials). The fabrication of the bottom flanges and the process for inducing camber is similar to the process used for the production of HDBTs.

The design and analysis process for GDBTs are essentially similar to that of HDBTs except the finite element model reflects section properties of thinner and stiffened webs and top flanges. UHPC (or other similar materials) are used for webs and flanges instead of that of HPC in the case of HDBTs and associated material properties are to be used for the design and analysis.

Improvements Over the Prior Art by the Preferred Second Embodiment

The preferred second embodiment of the present invention, GDBT, will also significantly reduce, if not fully eliminate, all inadequacies of the prior art described in this disclosure.

No tension will develop at the top fiber of the top flange and the web near both ends of the GDBT by the use of the staged fabrication method. The prestress is imparted into the bottom flange as an independent unit thereby no part of the GDBT will experience tension as a secondary effect.

The limitation in design efficiency in the state of the art due to the maximum tension on the top flange as a negative byproduct of prestress is completely eliminated.

With no tension from the secondary effects of prestress, the durability of the deck is substantially improved.

Fabrication is made easier and cheaper as the present invention negates the need for the draping of stands as well as the debonding of strands near the ends of a prestressed concrete component to reduce tension in the deck.

The present invention also negates the need for the special treatments of the anchorage zones in prestressed components which eases the fabrication process and reduces cost.

The camber variations from piece to piece of GDBT will be insignificantly small since the camber is measured and controlled by the shoring of the bottom flange before the rest of the GDBT is added to it. GDBTs will not need corrective measures when assembled in the field to construct the final structure.

Since GDBTs are using thin stiffened components for the web and the deck, the quantity of UHPC needed for its fabrication is substantially lower than DBTs using state of the art fabrication methods. Reduction in the quantity of UHPC needed for GDBT will limit the cost increase and make GDBTs economically viable.

GDBTs are substantially lower in weight compared to all superstructure types (steel or prestressed concrete) constructed using the state of the art.

GDBTs are substantially higher in durability compared to all superstructure types (steel or prestressed concrete) constructed using the state of the art.

The invention claimed is:

1. A method of forming a beam, comprising:

applying prestress to a lower flange of the beam either before casting and curing of a first concrete material of the lower flange, or after the casting and curing of the first concrete material of the lower flange, thereby forming a prestressed lower flange of the beam; and after the applying of the prestress, disposing a web of the beam on the prestressed lower flange, wherein force is not applied to the web as part of the applying of the prestress to the lower flange, wherein the disposing of the web of the beam on the prestressed lower flange comprises casting and curing a second concrete material on a top surface of the prestressed lower flange, wherein the first concrete material includes at least one of a lower permeability, a higher compressive strength, and a higher tensile strength than the second concrete material, and wherein the first concrete material comprises Ultra High Performance Concrete (UHPC), and the second concrete material comprises High Performance Concrete (HPC).

2. The method of claim 1, wherein the applying of the prestress to the lower flange comprises pre-tensioning of the lower flange.

3. The method of claim 1, wherein the applying of the prestress to the lower flange comprises:

assembling a form of the lower flange;

disposing metal reinforcement within said form;

applying tension to at least a part of the metal reinforcement; and disposing the first concrete material within said form.

4. The method of claim 1, wherein the applying of the prestress to the lower flange comprises post-tensioning the lower flange.

5. The method of claim 1, further comprising:

disposing a top flange on the web, wherein force is not applied to the top flange as part of the applying of the prestress to the lower flange.

6. The method of 1, wherein the casting and curing of the second concrete material comprises disposing the second concrete material onto a top surface of the first concrete material.

* * * * *